US009216445B2

(12) United States Patent
Muralidharan et al.

(10) Patent No.: US 9,216,445 B2
(45) Date of Patent: Dec. 22, 2015

(54) METHOD OF FORMING MAGNESIUM ALLOY SHEETS

(75) Inventors: Govindarajan Muralidharan, Knoxville, TN (US); Thomas R Muth, Knoxville, TN (US); David C Harper, Kingston, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 1109 days.

(21) Appl. No.: 13/197,297

(22) Filed: Aug. 3, 2011

(65) Prior Publication Data

US 2013/0031944 A1 Feb. 7, 2013

(51) Int. Cl.
*B21B 3/00* (2006.01)
*B21B 1/08* (2006.01)
*B21B 45/00* (2006.01)

(52) U.S. Cl.
CPC ... *B21B 3/00* (2013.01); *B21B 1/08* (2013.01); *B21B 45/004* (2013.01); *B21B 2265/24* (2013.01)

(58) Field of Classification Search
CPC ..... B21B 3/00; B21B 2265/24; B21B 39/02; B21B 39/14; B21B 39/16; B21B 33/00
USPC ..... 72/200
See application file for complete search history.

(56) References Cited

U.S. PATENT DOCUMENTS 3,258,953 A * 7/1966 Hermes et al. ..... 72/250
5,042,281 A * 8/1991 Metcalfe ..... 72/200
7,341,096 B2 3/2008 Van Der Winden
2010/0009212 A1* 1/2010 Utsunomiya et al. ..... 72/41
2010/0031720 A1 2/2010 Bozkaya et al.
2010/0180656 A1* 7/2010 Wang ..... 72/200
2010/0254849 A1 10/2010 Mukai et al.
2011/0162426 A1* 7/2011 Inoue et al. ..... 72/200

FOREIGN PATENT DOCUMENTS

WO 2009020619 A1 2/2009

OTHER PUBLICATIONS

Beausir, Benoit. "Analysis of Microstructure and Texture Evolution in Pure Magnesium During Symmetric and Assymmetric Rolling", Acta Materialia, 2009, pp. 5061-5077, vol. 57, Elsevier Ltd.

Huang, Xinsheng. "Microstructure and Texture of Mg—Al—Zn Alloy Processed by Differential Speed Rolling", Journal of Alloys and Compounds, 2008, pp. 408-412, vol. 457, Elsevier B.V.

(Continued)

*Primary Examiner* — Shelley Self
*Assistant Examiner* — Pradeep C Battula
(74) *Attorney, Agent, or Firm* — Novak Druce Connolly Bove + Quigg LLP

(57) ABSTRACT

A machine for asymmetric rolling of a work-piece includes pair of rollers disposed in an arrangement to apply opposing, asymmetric rolling forces to roll a work-piece therebetween, wherein a surface of the work-piece is rolled faster than an opposite surface of the work-piece; and an exit constraint die rigidly disposed adjacent an exit side of the pair of rollers so that, as the work-piece exits the pair of rollers, the work-piece contacts the exit constraint die to constrain curling of the work-piece.

8 Claims, 18 Drawing Sheets

(56) References Cited

OTHER PUBLICATIONS

Kim, W.J., "Microstructure and Mechanical Properties of Mg—Al—Zn Alloy Sheets Severely Deformed by Asymmetrical Rolling", Scripta Materialia, 2008, pp. 309-312, vol. 56, Elsevier Ltd.

Shimamura, T., "Texture and Microstructure Control of Al—Mg—Si Alloy Sheet by Differential Speed Rolling", Materials Science Forum, 2007, pp. 1443-1447, vol. 558-559, Trans Tech Publications, Switzerland.

* cited by examiner

METHOD OF FORMING MAGNESIUM ALLOY SHEETS

STATEMENT REGARDING FEDERALLY SPONSORED RESEARCH

The United States Government has rights in this invention pursuant to contract no. DE-AC05-00OR22725 between the United States Department of Energy and UT-Battelle, LLC.

BACKGROUND OF THE INVENTION

Magnesium is the lightest known structural metal, approximately ⅕ the density of steel, ½ the density of titanium, and ⅔ the density of aluminum. Magnesium alloys represent potential weight savings and therefore fuel savings across the entire transportation industry. Predominant texture (also called "basal texture", and hereinafter called "texture") in magnesium alloys is an important factor limiting the formability of magnesium alloys. Certain cost barriers have heretofore precluded widespread utilization of magnesium and magnesium alloys. Two cost factors addressed in recent initiatives include (1) elimination of rare earth alloying elements and (2) lowering the forming temperature.

Magnesium alloys containing rare earth elements have been developed that have improved formability over conventional magnesium alloys, and allow forming to take place at temperatures below 200° C. The 200° C. threshold is desirable for economic reasons and is the approximate upper temperature limit where conventional oil based lubricants can be used for die lubrication during forming. The removal of the die lubricants with solvents in automated machinery falls within the normal parameters associated with low cost forming operations. Forming operations that are required to take place above 200° C. use solid lubricants where post forming lubricant removal is by mechanical means, followed by surface buffing to achieve acceptable surface finishes. The labor input and processing complexities associated with removal of solid lubricants after forming adds undue cost and limits magnesium's potential use in high volume complex geometry automotive panels. The rare earth containing alloys that allow forming below 200° C. however are more costly and could become scarce due to the supply of rare earth metals. Therefore, initiatives for magnesium sheet in automotive application have been focused on achieving equivalent or superior formability at 200° C. and below, without rare earth additions.

Conventional non rare earth containing magnesium and magnesium alloy sheet require forming temperatures above 300° C., due to the presence of an undesirable strong hexagonal close packed crystalline texture, inherent in the sheet after conventional processing that includes symmetric rolling. Such a texture is the reason metal sheet is insufficiently ductile for forming into useful shapes below 200° C. Therefore a need exists for processing magnesium sheet by shear rolling in the range of 180-250° C. to form a disrupted texture, and avoid formation of an undesirable, strong hexagonal close packed texture, thereby producing desired forming characteristics at 200° C. and below.

The skilled artisan will find helpful information regarding the use of asymmetric rolling to decrease the strong texture of Mg in the following publication:

Benoît Beausir, et al., "Analysis of microstructure and texture evolution in pure magnesium during symmetric and asymmetric rolling", Acta Materialia 57 (2009) 5061-5077.

The skilled artisan will find helpful information regarding the use of asymmetric rolling to decrease the strong basal texture of Mg—Al—Zn alloy in the following publications:

Xinsheng Huang, et al., "Microstructure and texture of Mg—Al—Zn alloy processed by differential speed rolling", Journal of Alloys and Compounds, 457 (2008), 408-412.

W. J. Kim et al., "Microstructure and mechanical properties of Mg—Al—Zn alloy sheets severely deformed by asymmetrical rolling", Scripta Materialia 56 (2007) 309-312.

BRIEF SUMMARY OF THE INVENTION

In accordance with one aspect of the present invention, the foregoing and other objects are achieved by a machine for asymmetric rolling of a work-piece that includes a pair of rollers disposed in an arrangement to apply opposing, asymmetric rolling forces to roll a work-piece therebetween, wherein a surface of the work-piece is rolled faster than an opposite surface of the work-piece; and an exit constraint die rigidly disposed adjacent an exit side of the pair of rollers so that, as the work-piece exits the pair of rollers, the work-piece contacts the exit constraint die to constrain curling of the work-piece.

In accordance with another aspect of the present invention, a method of rolling a work-piece includes the steps of heating a work-piece to a preselected rolling temperature, rolling the work-piece asymmetrically to form a tilted crystalline texture in the work-piece, and constraining the rolled work-piece in at least one direction to limit curling of the rolled work-piece and maintain the tilted crystalline texture as the rolled work-piece exits the rolling step.

In accordance with a further aspect of the present invention, a method of rolling a magnesium-containing metal body includes the steps of heating the metal body to a preselected rolling temperature in the range of 130° C. to 350° C., rolling the metal body asymmetrically to form a tilted crystalline texture in the metal body, and constraining the rolled metal body in at least one direction to limit curling of the rolled metal body and maintain the tilted crystalline texture as the rolled metal body exits the rolling step.

Figure 1:
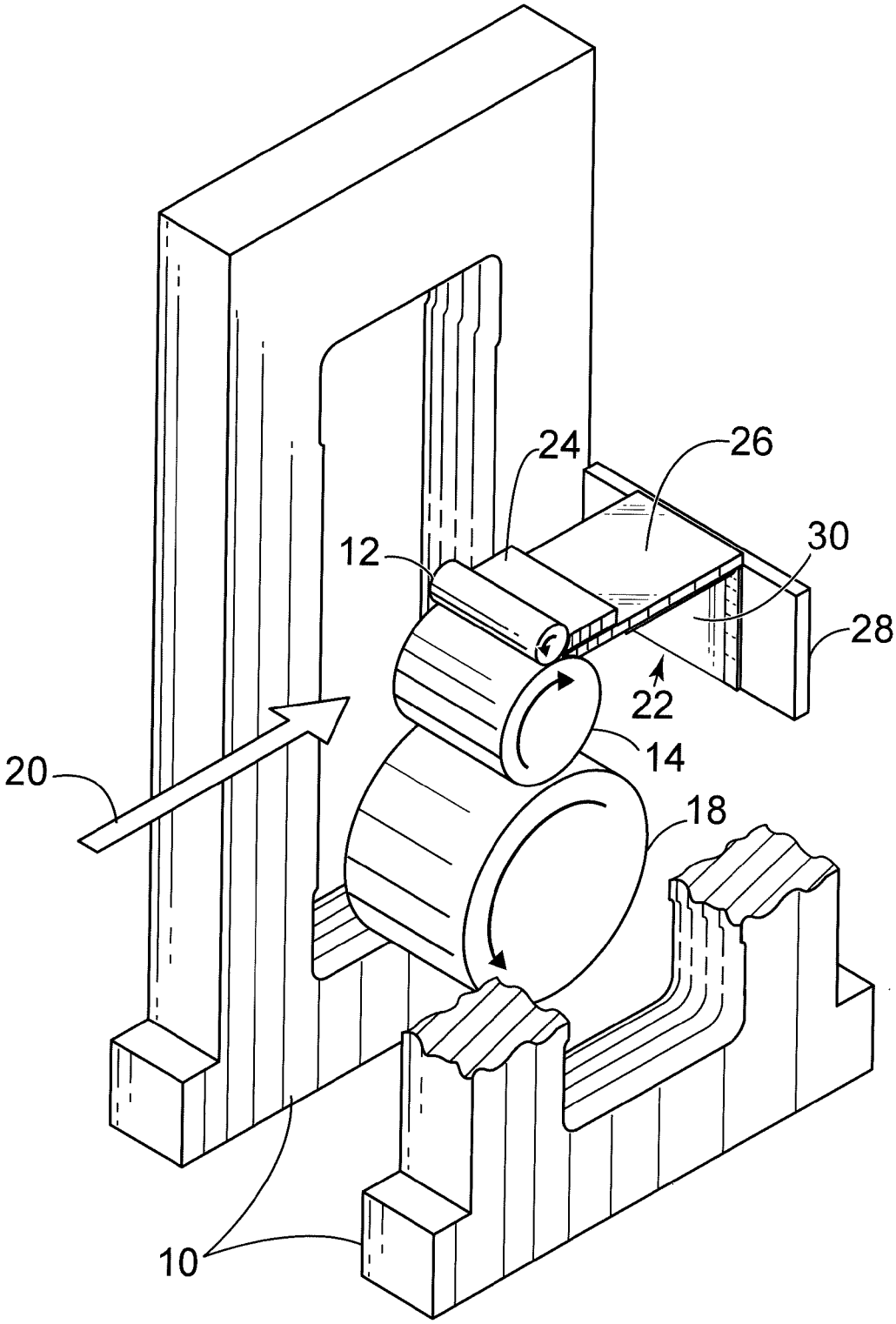
FIG. 1 is a schematic, cutaway, isometric view of a typical rolling mill equipped with two different diameter work rolls and an exit constraint die in accordance with an example of the present invention.
Figure 2:
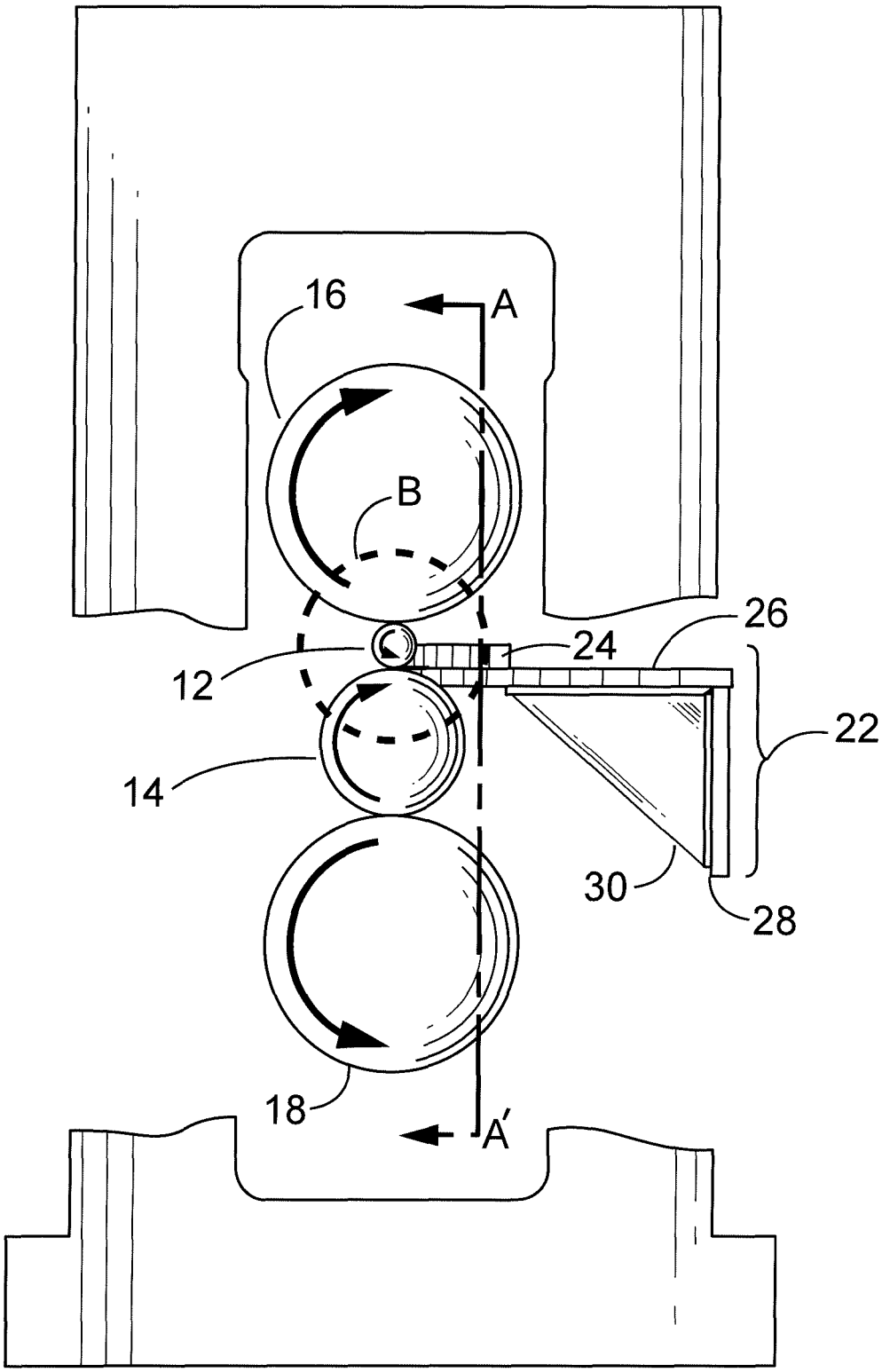
FIG. 2 is a schematic, cutaway, side view of a typical rolling mill equipped with two different diameter work rolls and an exit constraint die in accordance with an example of the present invention.
Figure 4:
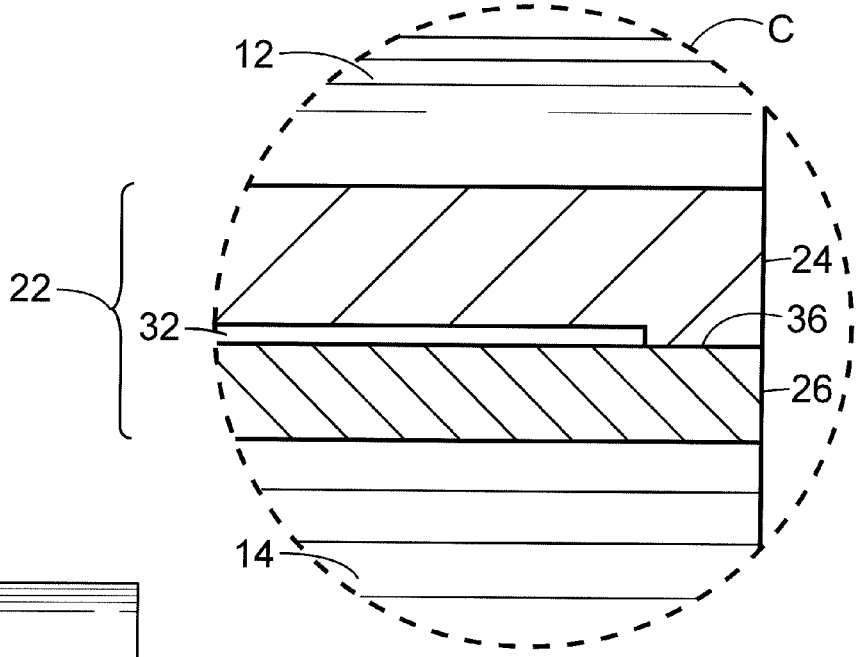
FIG. 4 is an enlargement of inset C of FIG. 3.
Figure 3:
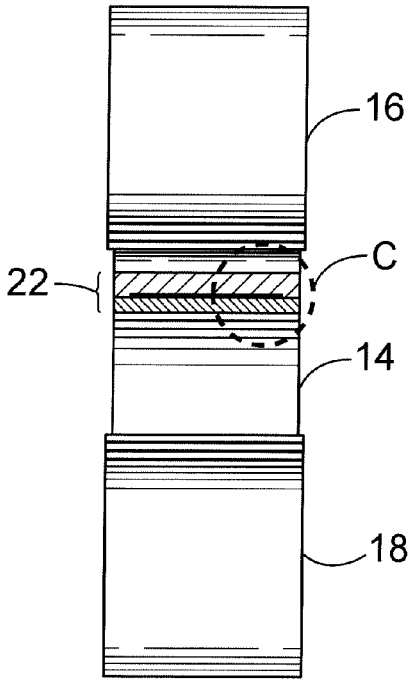
FIG. 3 is a rear view through section A-A' of FIG. 2.

For a better understanding of the present invention, together with other and further objects, advantages and capabilities thereof, reference is made to the following disclosure and appended claims in connection with the above-described drawings.

DETAILED DESCRIPTION OF THE INVENTION

The present invention involves applying asymmetric rolling (also called shear rolling) to a metallic work-piece at temperatures below 300° C. in order to appreciably disrupt the hexagonal close packed crystalline texture and produce an improved, tilted texture having significantly improved formability. The present invention is suitable for rolling hexagonal close packed, body center cubic, and face centered cubic crystalline structured metals and alloys that comprise, for example, magnesium, beryllium, titanium, tantalum, iron, aluminum and copper. The invention is particularly suitable for rolling rare-earth-free magnesium alloys such as AZ31B for example, which is commercially available from sundry sources worldwide.

The present invention is most suited for processing metallic sheets of finite length where the processed work-piece is essentially flat. The skilled artisan will recognize that the present invention is not intended for processing roll-to-roll work-pieces.

Referring to FIGS. 1-8, at least one example of the present invention is described. A typical four-high rolling mill is shown, having a frame 10, working rolls 12, 14, and backing rolls 16, 18. An arrow 20 shows the direction of travel of a work-piece into the working rolls 12, 14. The upper working roll 12 is smaller in diameter (3 times smaller in this example) than the lower working roll 14 but rotates at the same number of revolutions per minute. Thus, the upper working roll 12 will move the upper surface of a work-piece at a slower rate than the lower working roll 14; by a factor of ⅓ in this example. The result is a significant upward curling of the work-piece as it exits the working rolls 12, 14. Such curling can be so significant as to cause the work-piece to follow the surface of the upper working roll 12.

In accordance with an example of the present invention, an exit constraint die assembly 22 is rigidly disposed adjacent the exit side of the working rolls 12, 14. The exit constraint die assembly 22 is comprised of an upper stripper plate 24, a lower stripper plate 26, and support means, including a mounting base 28 and bracket 30. The exit constraint die assembly 22 defines a slot 32 through which a work-piece exiting the working rolls 12, 14 must pass. The upper stripper plate 24 has a nose portion 34 terminating in a stripper blade 38 that fits closely to, but generally should not touch the upper working roll 12 in order to strip (catch) the exiting work-piece and prevent it from curling upwardly around the upper working roll 12. For example, the stripper blade 38 can be in the range 0.001" to 0.005" from the upper working roll 12.

In this example the upper stripper plate 24 has a length that defines the length of the slot 32. The lower stripper plate 26 can, as shown, extend further rearward for its support and also serves as a support for a work-piece exiting the slot 32. The skilled artisan will recognize that the upper stripper plate 24 can be of greater length so that the lower stripper plate 26 can define the length of the slot 32, and that upper stripper plate 24 and the lower stripper plate 26 can be of the same length.

The upper stripper plate 24 has ear portions 36 that determine the height and define the width of the slot 32. The lower stripper plate 26 functions to further define the slot 32 and ensure that, upon exiting the exit constraint die assembly 22, the work-piece is as straight as desired, depending on dimensions and placement of the exit constraint die assembly 22 that defines the slot 32.

Height of the slot 32 relative to the thickness of the work-piece as it exits the working rolls 12, 14 is important; it should be sufficiently small for the work-piece to be straightened to the desired extent, but not so small as to cause excessive friction, resulting in the work-piece failing to pass through the slot and crumpling. Moreover, the length of the slot 32 should also be sufficiently long for the work-piece to be straightened to the desired extent, but not so long as to cause excessive friction, resulting in the work-piece failing to pass through the slot and crumpling.

In accordance with the present invention, it is critically important to pass the work-piece through the exit constraint die assembly 22 in order to straighten the work-piece.

Figure 6:
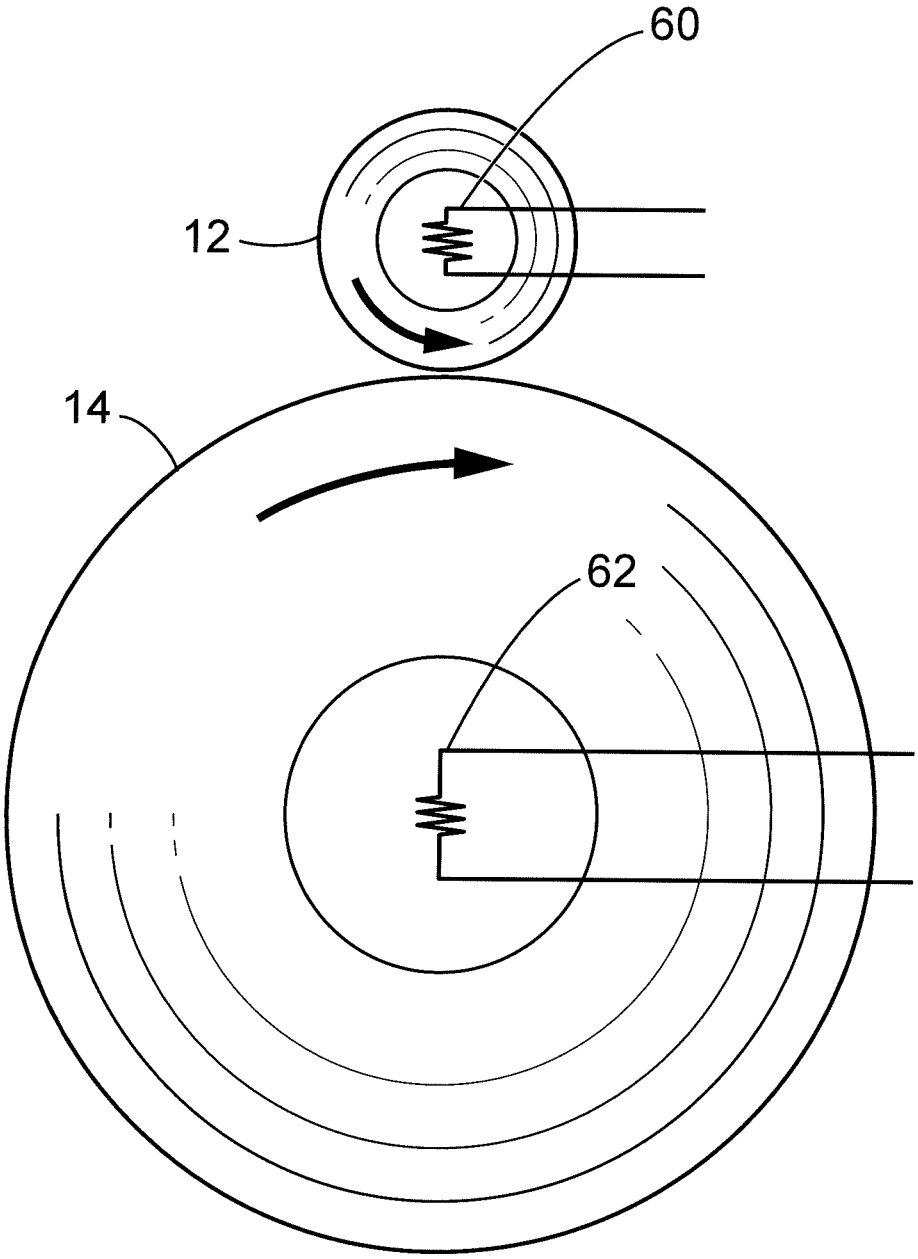
FIG. 6 is an enlarged view of the work rolls shown in FIG. 2 with optional heaters.
Figure 8:
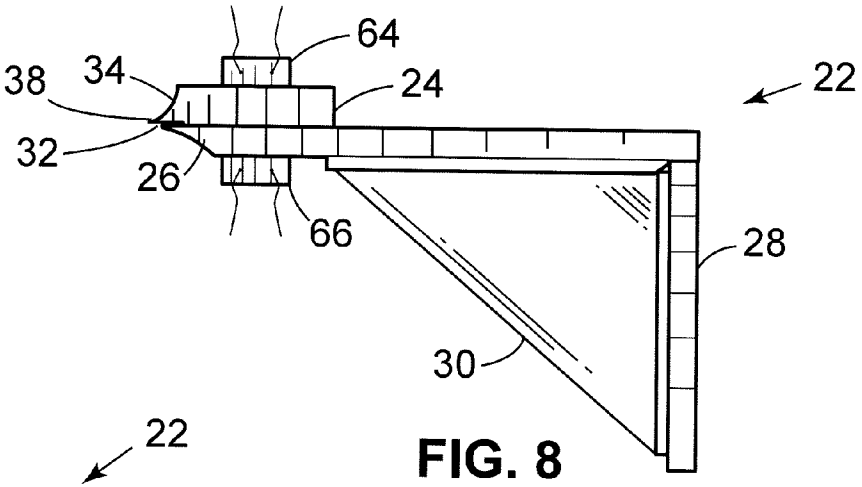
FIG. 8 is an enlargement of the exit constraint die assembly of FIG. 2 with optional heaters.
Figure 7:
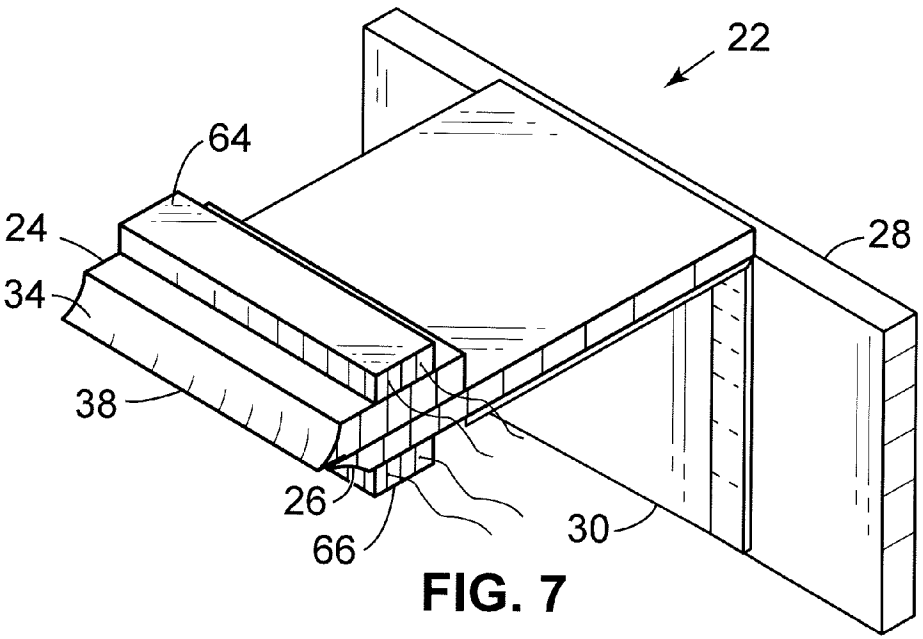
FIG. 7 is an enlargement of the exit constraint die assembly of FIG. 1 with optional heaters.

Isothermal processing (rolling and/or exit constraint) is optional, but beneficial for processing in various cases where precise control of temperature is desired. For example, one or both of the working rolls 12, 14 can be heated by respective core resistance heaters 60, 62, respectively, as shown in FIG. 6. Moreover, for example, the exit constraint die assembly 22 can be heated by resistance heaters 64, 66 as shown in FIGS. 7, 8. The skilled artisan will recognize that many conventional means can be adapted for heating the working rolls 12, 14 and the exit constraint die assembly 22. Such means can include induction heaters, flame heaters, infrared heaters, and/or resistance heaters placed differently than those described as examples hereinabove.

In some cases, particularly with extremely thin work-pieces, it may be helpful to employ means for reducing friction between the work-piece and the exit constraint die assembly 22. For example, a fluid lubricant may be applied to the work-piece and/or the exit constraint die assembly 22. Moreover, the upper stripper plate 24, with which the work-piece first comes in contact, and therefore is most prone to friction, can be polished and/or coated with a friction-reducing coating such as a polymer or glaze. Examples of friction-reducing coating materials include, but are not limited to graphite and graphite-containing materials, and fluoropolymers such as polytetrafluoroethylene (PTFE).

Figure 5:
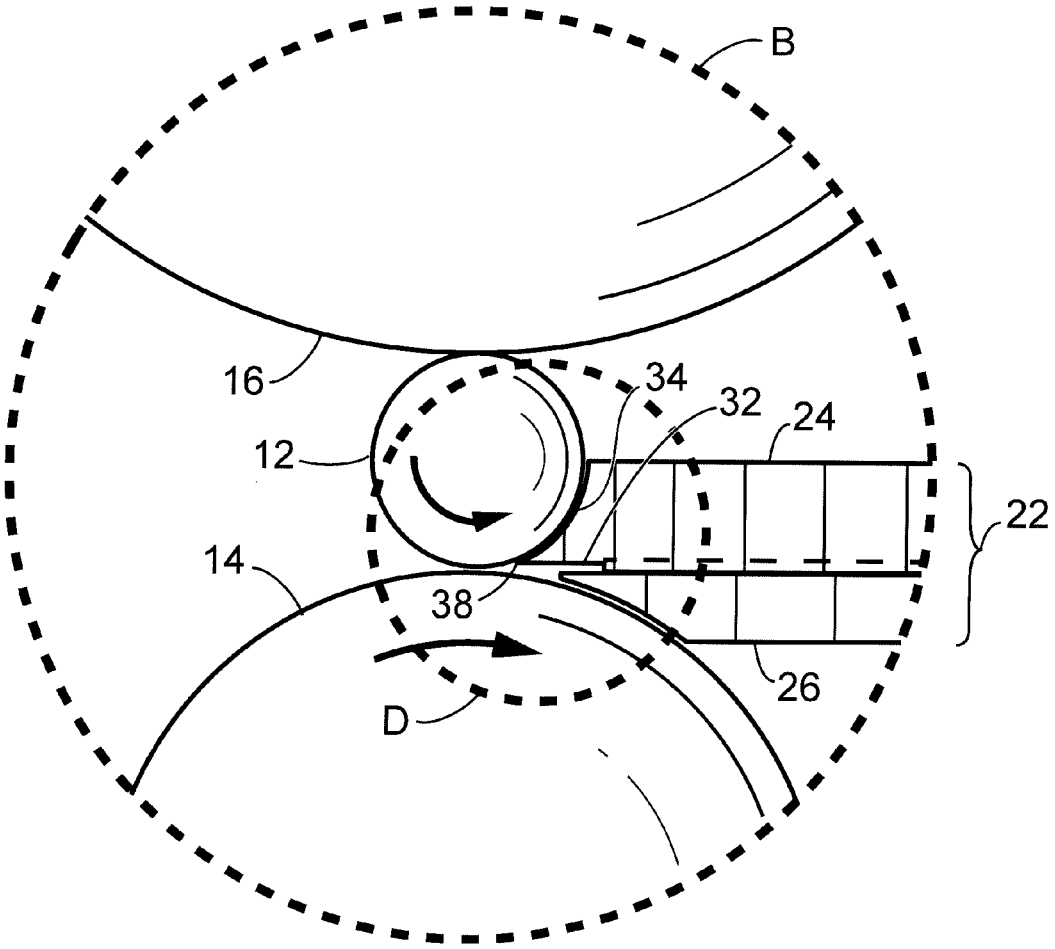
FIG. 5 is an enlargement of inset B of FIG. 2.
Figure 9:
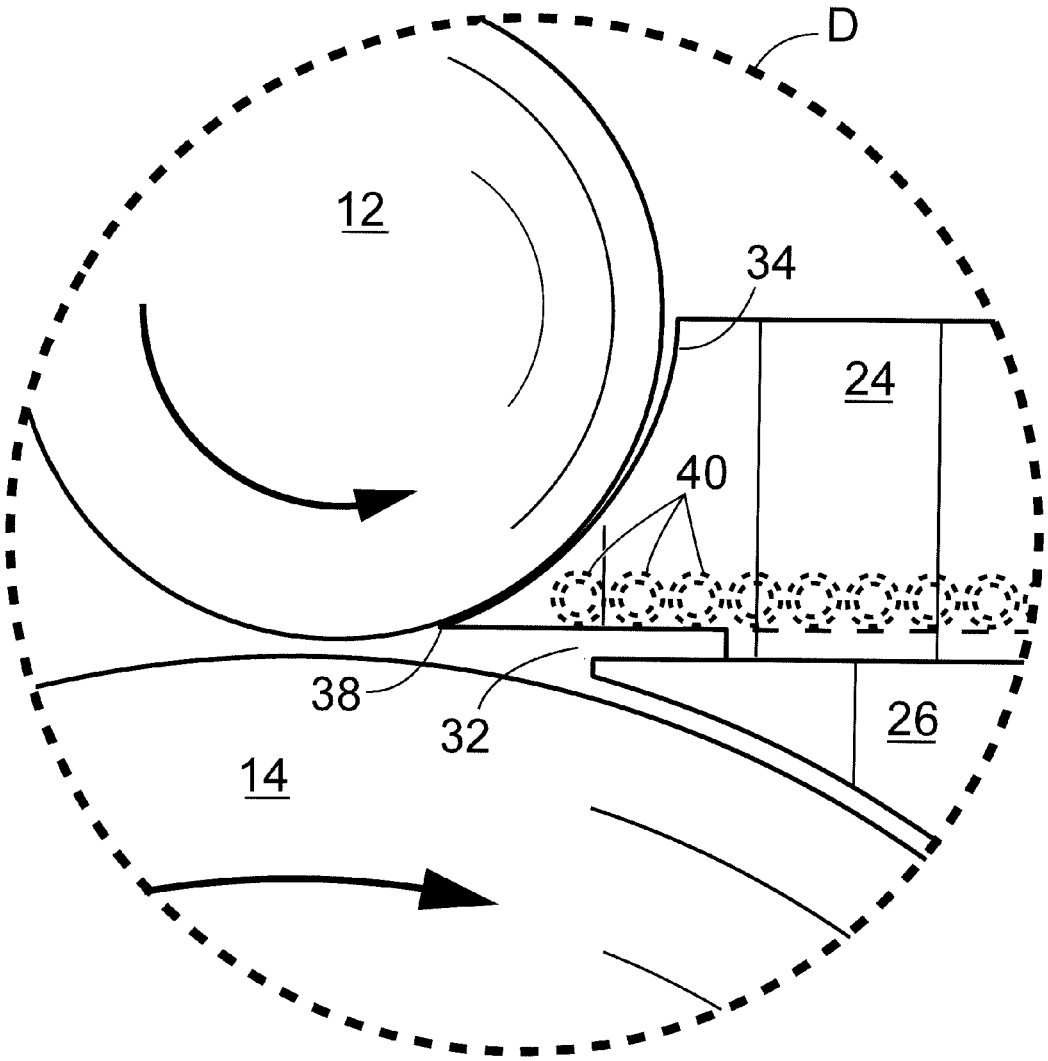
FIG. 9 is an enlargement of inset D of FIG. 5 showing friction-reducing rollers in accordance with an example of the present invention.

FIG. 9 shows detail of inset D of FIG. 5 and adds an example of the present invention wherein the upper stripper plate 24 is fitted with rollers 40 that contact the work-piece, greatly reducing friction. Rollers 40 can be passive as shown, or can be driven to rotate at the same speed as the work-piece to further reduce friction. The skilled artisan will recognize that many conventional mechanisms are available to drive the rollers 40, such as, for example, a motion transfer connection (gears, shafts, chains, and the like) to the working rolls 12, 14, or to a discrete motor.

Figure 10:
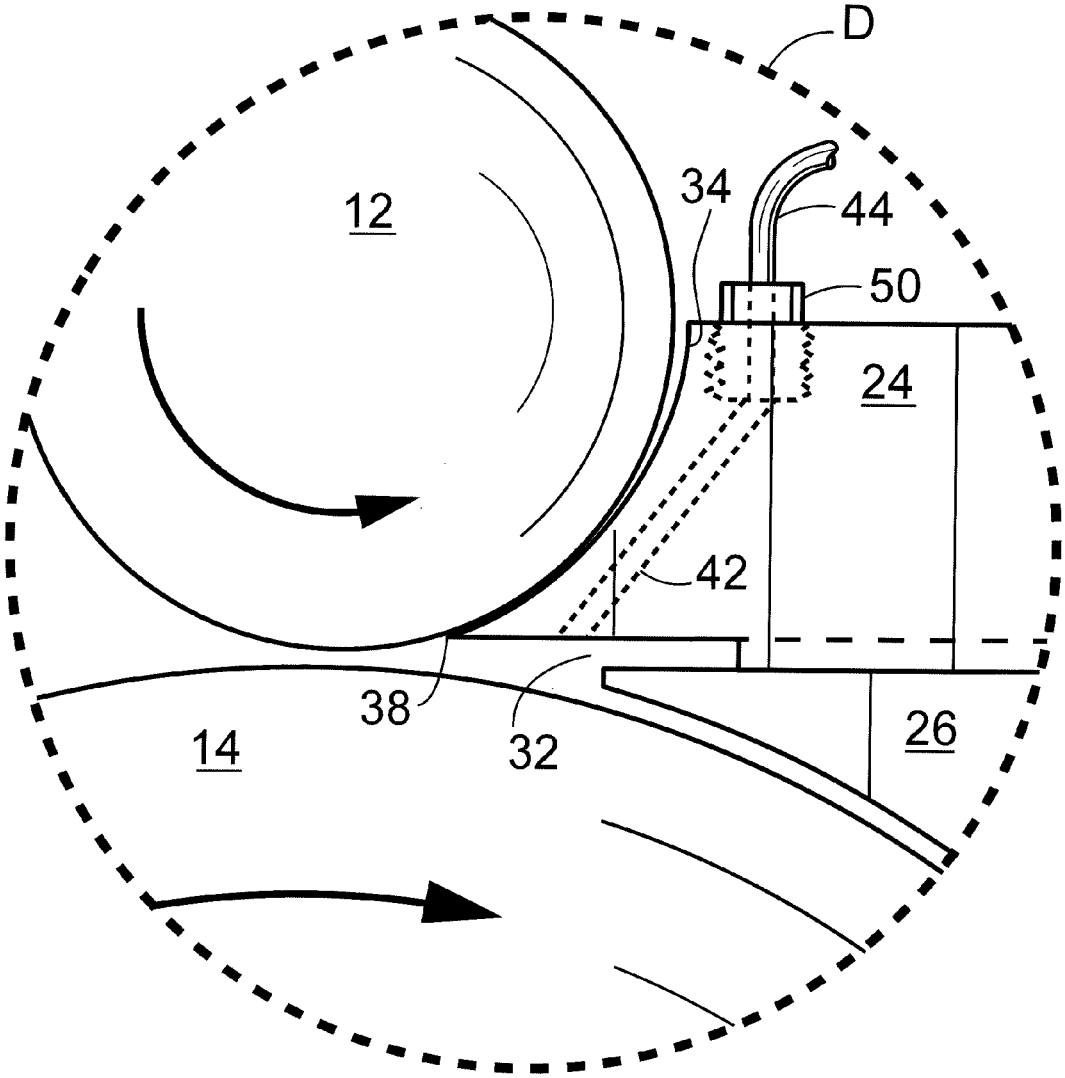
FIG. 10 is an enlargement of inset D of FIG. 5 showing friction-reducing liquid lubricating system components in accordance with an example of the present invention.
Figure 11:
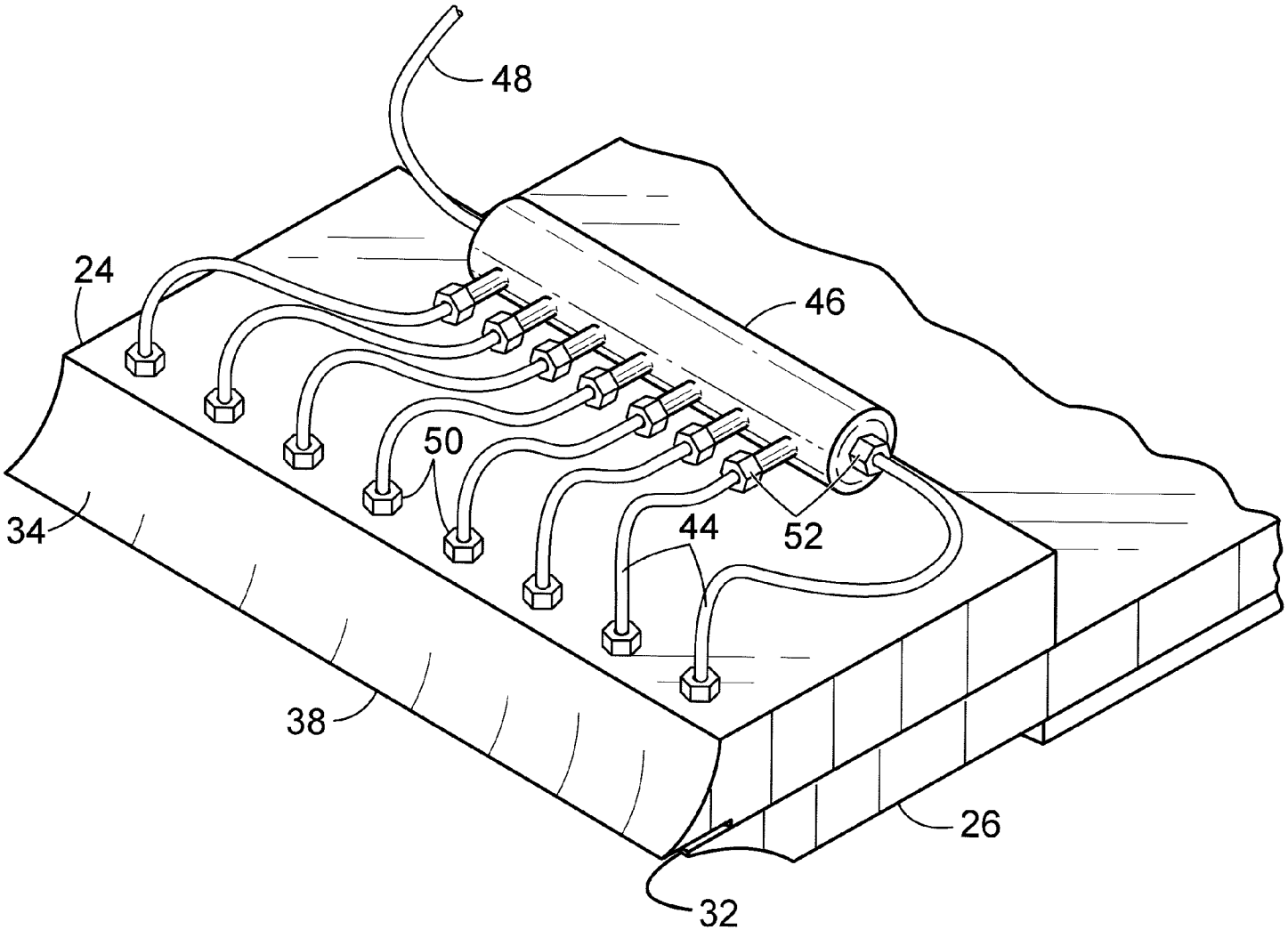
FIG. 11 is an enlargement of the exit constraint die of FIG. 1 showing friction-reducing liquid lubricating system components in accordance with an example of the present invention.

FIG. 10, which shows detail of inset D of FIG. 5, and FIG. 11 add an example of the present invention wherein the upper stripper plate 24 is adapted for applying a fluid lubricant between the work-piece and the upper stripper plate 24. A series of channels 42 are milled into the upper stripper plate 24. Fluid distribution tubes 44 lead from the channels to a manifold 46. The fluid distribution tubes 44 are secured to the upper stripper plate 24 and the manifold 46 by respective fittings 50, 52. A supply line 48 is also connected to the manifold 46. Fluid is forced successively through the supply line 48, manifold 46, fluid distribution tubes 44, channels 42, and into the slot 32 between the work-piece and the upper stripper plate 24.

The skilled artisan will recognize that FIGS. 10, 11 illustrate an example of means for applying a fluid lubricant to the work-piece and/or the exit constraint die assembly 22. Many modifications are possible. For example, channels 42 may be milled so that they converge into fewer or even a single fluid distribution tube 44. Moreover, the number, shapes, configuration, and array of the openings of the channels 42 into the slot 32 may be modified to facilitate even fluid distribution and/or minimize the potential for obstructing the free passage of the leading edge of the work-piece. Such modifications are considered to be within the skill of the art and fall within the scope of the present invention.

Tests were run in accordance with examples of the present invention using a rolling mill adapted for asymmetric rolling by employing different size rollers rotating at the same revolutions per minute. However rolling mills can be adapted for asymmetric rolling in accordance with the present invention by employing same size rollers rotating at different speeds, or by employing different size rollers rotating at different speeds.

Asymmetric rolling of two magnesium alloys, AZ31B and ZEK100, was tested on a 4 high rolling mill as shown in FIGS. 1-8. A preheat temperature of 130° C. and 5% true strain per pass was a tolerable set of rolling conditions for both alloys whereby both materials could deform without undue cracking up to 50% cumulative true strain. The rolling mill was configured to directly drive two work rolls of varying diameters. The small (top) roll was 3 inches in diameter, and the bottom (large) roll was 9 inches in diameter, making the differential surface speed of the rolls a 3 to 1 variation. The mill was equipped with an exit constraint die assembly as shown to deflect the magnesium through a 0.1 inch slot during rolling to control curling due to the asymmetric deformation.

Rolling temperature was controlled so that rolling and exit constraint were carried out at temperatures in a range of about 130° C. to about 350° C. Achievable thickness reduction per pass can be increased by increasing the rolling temperature, but the increased heating cost will, at some temperature, offset the efficiency thereof.

Roll pass sequence can be carried out as follows, considering rolling temperature and reduction-per-pass. Reduction per pass in this work varied from 2%-25% with an optimal reduction per pass being approximately 5% based on the mill peculiarities. Different alloys of magnesium have different working temperatures, and are typically deformed below 400° C. Each alloy is unique in its ability to accept deformation by rolling without detrimental cracking. Generally, alloys with rare earth additions have a higher tolerance for large amounts of deformation at lower temperatures than do the conventional alloys such as AZ31B, for example. Variables that effect the reduction per pass limits are starting material thickness, material width, roll diameter, alloy composition, mill torque capabilities, mill separating force capabilities, roll temperature and of course the unique deformation characteristics of the metal. In all cases the present invention performs its design intent.

The skilled artisan will recognize that a rolling mill can be configured in the inverted configuration whereby the upper working roll 12 will move the upper surface of a work-piece at a faster rate than the lower working roll 14. The exit constraint system can be inverted accordingly to accommodate down-curling. Rolling mill configurations that are tooled for work-piece up-curling or work-piece down-curling during asymmetric rolling are considered to fall within the scope of the invention.

Example I

Magnesium alloy AZ31B work-pieces were preheated to 135° C. and rolled in accordance with the present invention as follows: Two sequences were rolled on AZ31B 1) maximal deformation per pass to find the limits of deformation and 2) sequential passes to find the deformation limits in multiple passes. The maximum achievable deformation in a single pass at 135° C. preheat for AZ31B was 20%. Deformation above 20% strain resulted in material failure. The single pass schedules for three samples are shown below in Table 1.

TABLE 1

| Sheet ID | Pre-Pass Temperature (° C.) | Desired ϵ | Mill Set | Actual Post-Pass Thickness | Actual Strain |
|---|---|---|---|---|---|
| AZ31B-1 | 135 | −0.051 | 0.084 | 0.086 | 0.05 |
| AZ31B-2 | 135 | −0.105 | 0.079 | 0.082 | 0.09 |
| AZ31B-3 | 135 | −0.22 | 0.070 | 0.074 | 0.20 |

Example II

The process of Example I was repeated, but with a multiple pass schedule shown in Table 2, which allowed for an accumulation of strain up to 28% when a sample of AZ31B was heated to 135° C.

TABLE 2

| Sheet ID | Pre-Pass Temperature (° C.) | Desired ϵ | Mill Set | Actual Post-Pass Thickness | Actual Strain |
|---|---|---|---|---|---|
| AZ31B-4 | 135 | −0.05 | 0.087 | 0.088 | 0.07 |
| | | | 0.081 | 0.082 | 0.07 |
| | | | 0.076 | 0.077 | 0.06 |

TABLE 2-continued

| Sheet ID | Pre-Pass Temperature (° C.) | Desired ϵ | Mill Set | Actual Post-Pass Thickness | Actual Strain |
|---|---|---|---|---|---|
| | | | 0.071 | 0.073 | 0.05 |
| | | | 0.066 | 0.071 | 0.03 |
| Cumulative Total Actual Strain | | | | | 0.28 |

The present invention performed according to design and restricted the exit curl without deleteriously affecting the rolling process or desired results.

Example III

Figure 12:
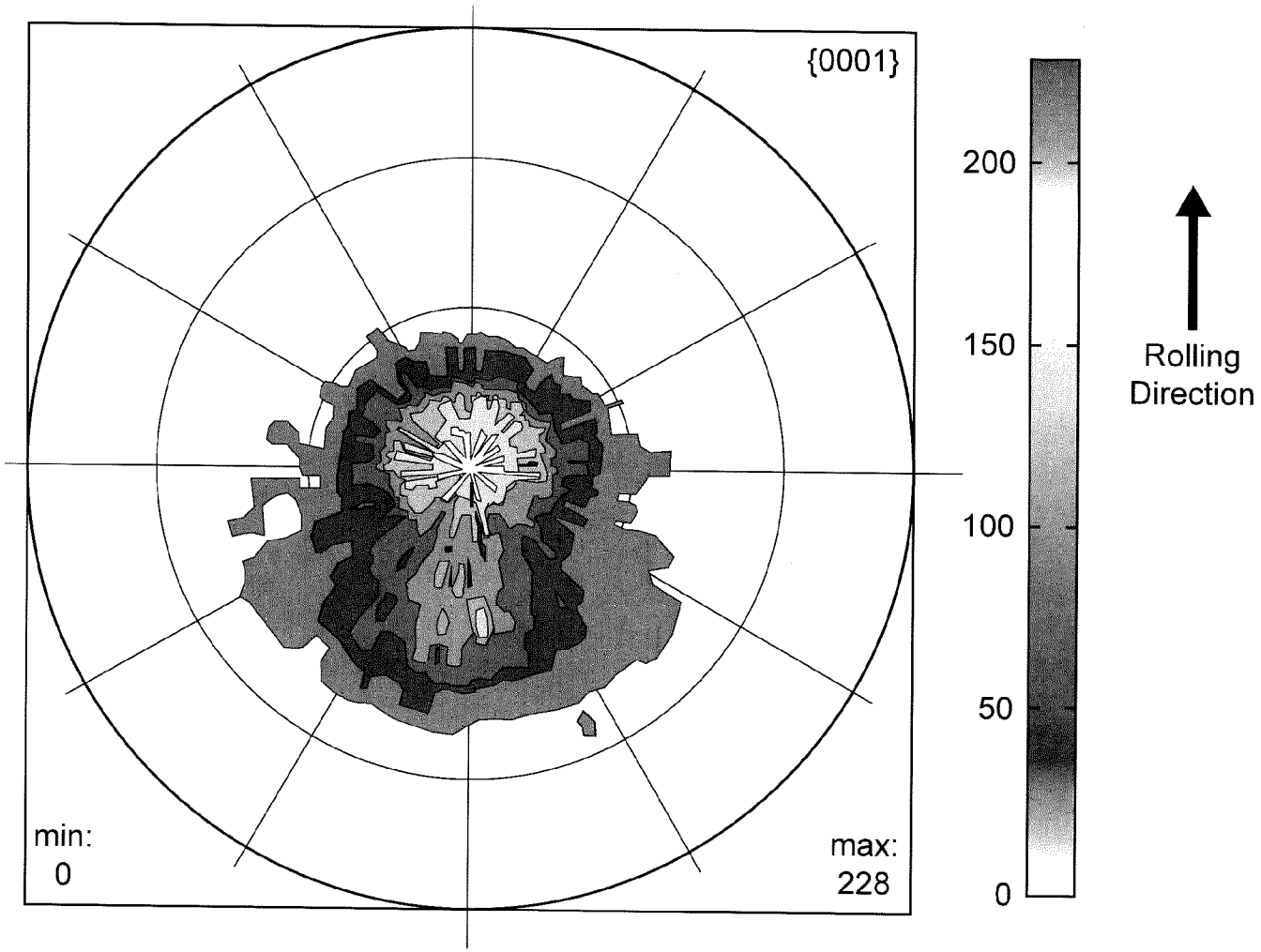
FIG. 12 is a {0002} pole figure observed near the fast roll surface in a specimen of AZ31B following 22% Reduction at 180° C. in accordance with an example of the present invention.
Figure 13:
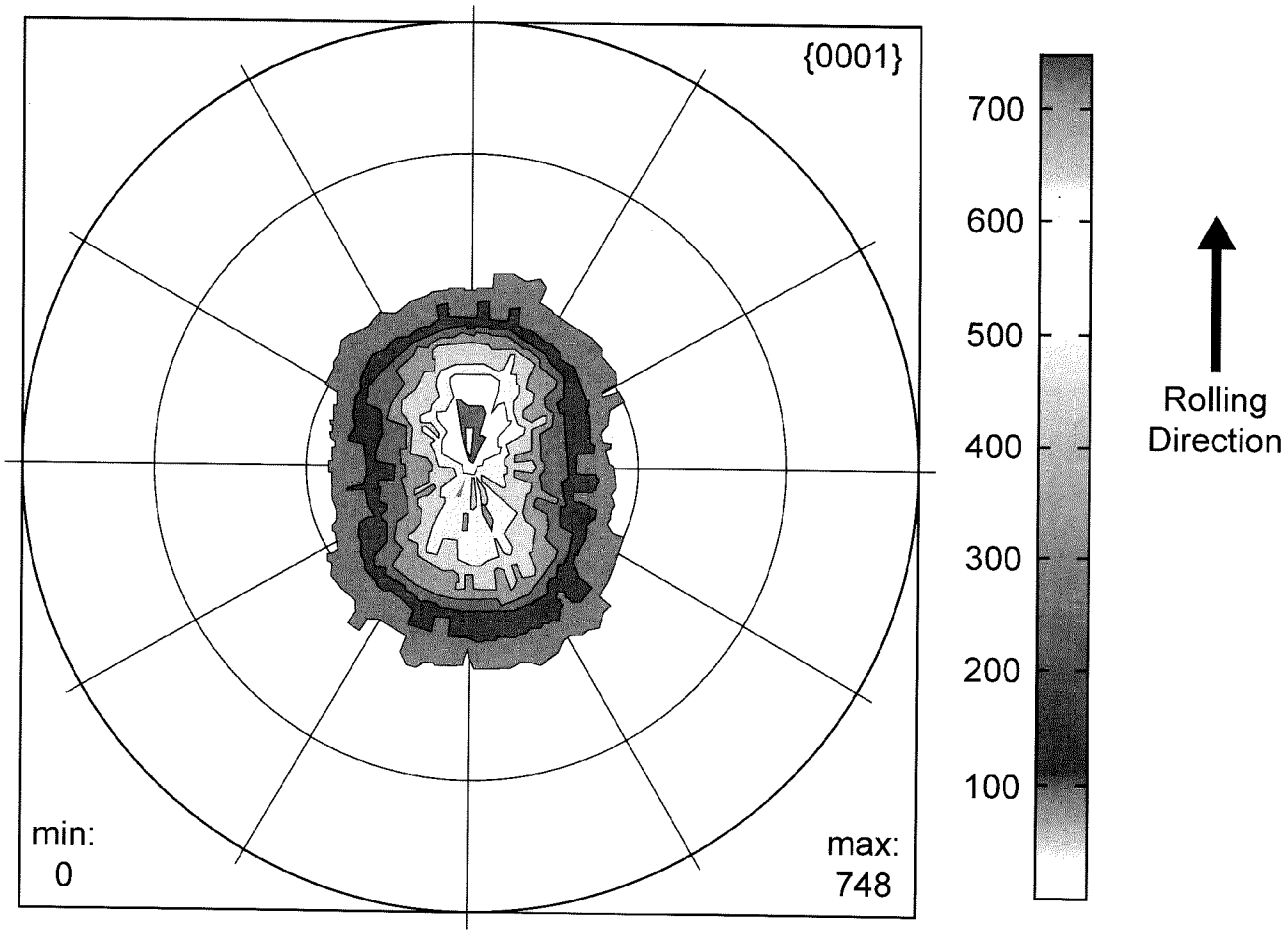
FIG. 13 is a {0002} pole figure observed in the center region in a specimen of AZ31B following 22% Reduction at 180° C. in accordance with an example of the present invention.
Figure 14:
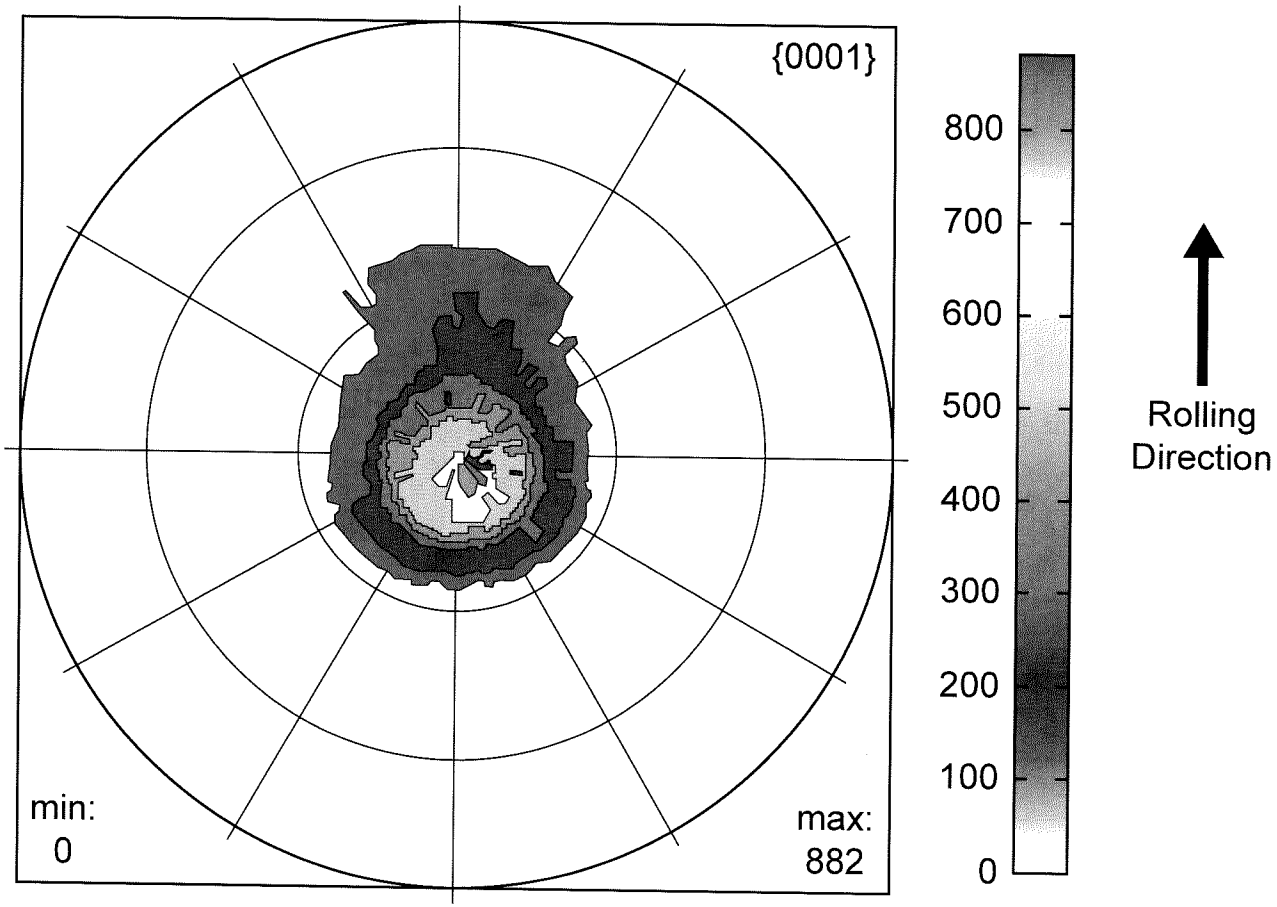
FIG. 14 is a {0002} pole figure observed near the slow roll surface in a specimen of AZ31B following 22% Reduction at 180° C. in accordance with an example of the present invention.

Magnesium alloy AZ31B work-pieces were preheated to 180° C. and rolled in accordance with the present invention as follows: A multiple pass sequence of 4% to 8% strain per pass with a preheat temperature of 180° C. is shown in Table 3. The present invention successfully restricted the exit curl of the sheet on each pass. FIGS. 12-14 show a broad distribution of {0002} poles observed through the thickness in the specimen; the tilted basal texture is evident.

TABLE 3

| Sheet ID | Pre-Pass Temperature (° C.) | Desired ϵ | Mill Set | Actual Post-Pass Thickness | Actual Strain |
|---|---|---|---|---|---|
| AZ31B-5 | 180 | −0.05 | 0.087 | 0.090 | 0.04 |
| | | | 0.081 | 0.083 | 0.08 |
| | | | 0.076 | 0.078 | 0.06 |
| | | | 0.071 | 0.073 | 0.07 |
| Cumulative Total Actual Strain | | | | | 0.25 |

Example IV

Figure 15:
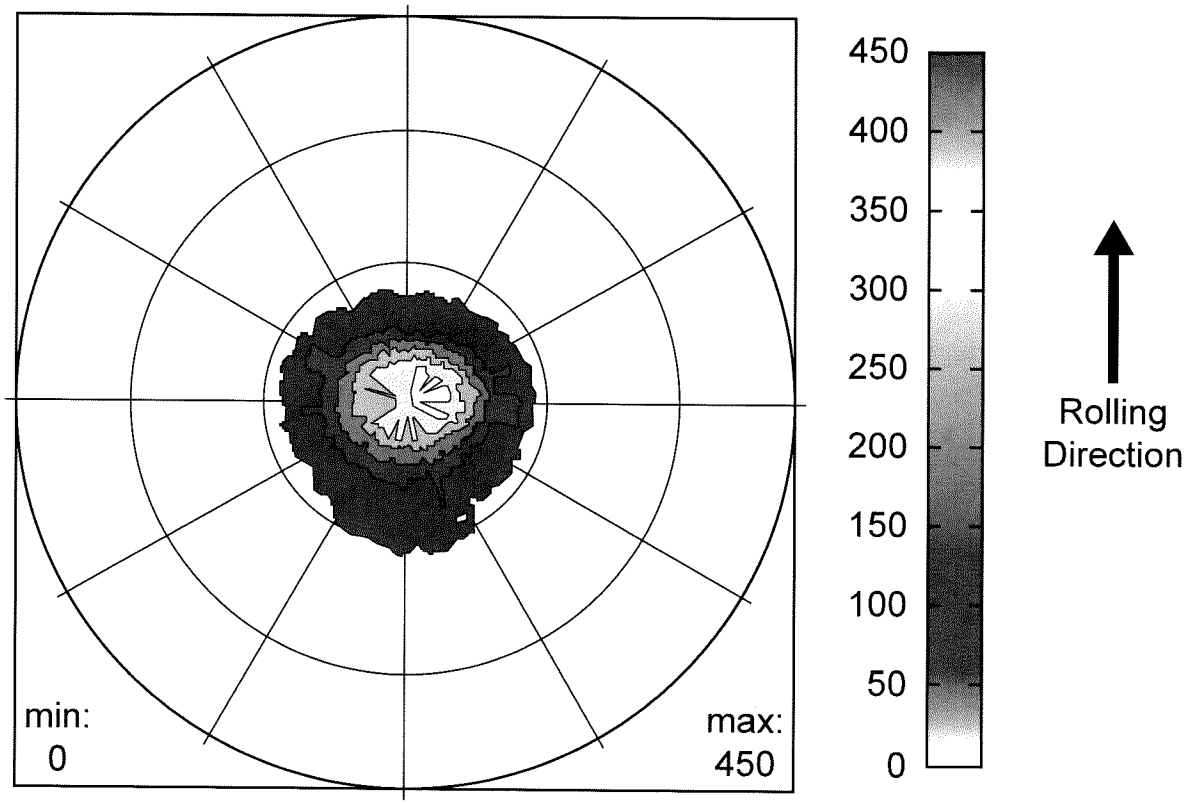
FIG. 15 is a {0002} pole figure observed near the fast roll surface in a specimen of AZ31B following multi-pass rolling at 225° C. in accordance with an example of the present invention.
Figure 16:
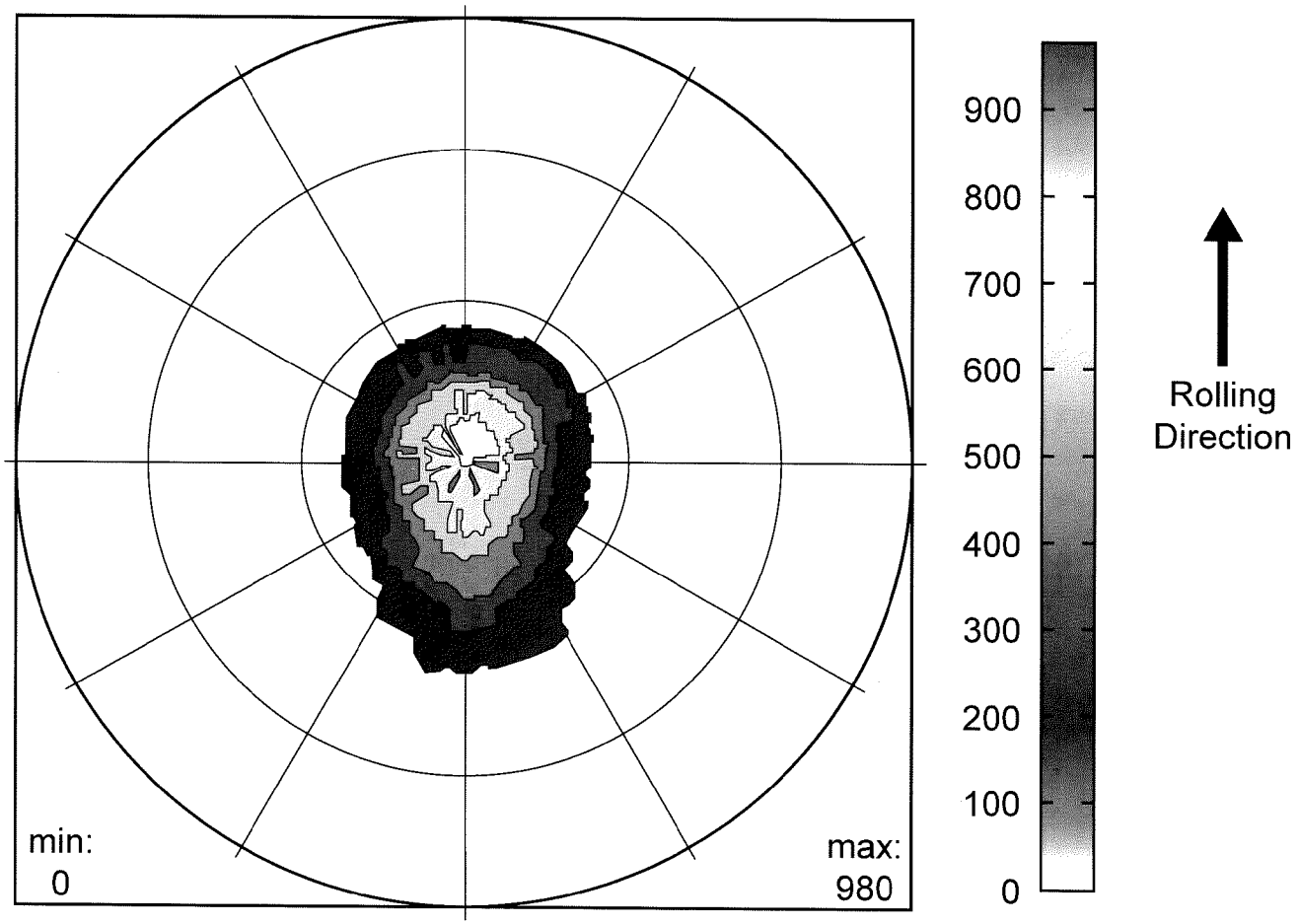
FIG. 16 is a {0002} pole figure observed in the center region in a specimen of AZ31B following multi-pass rolling at 225° C. in accordance with an example of the present invention.
Figure 17:
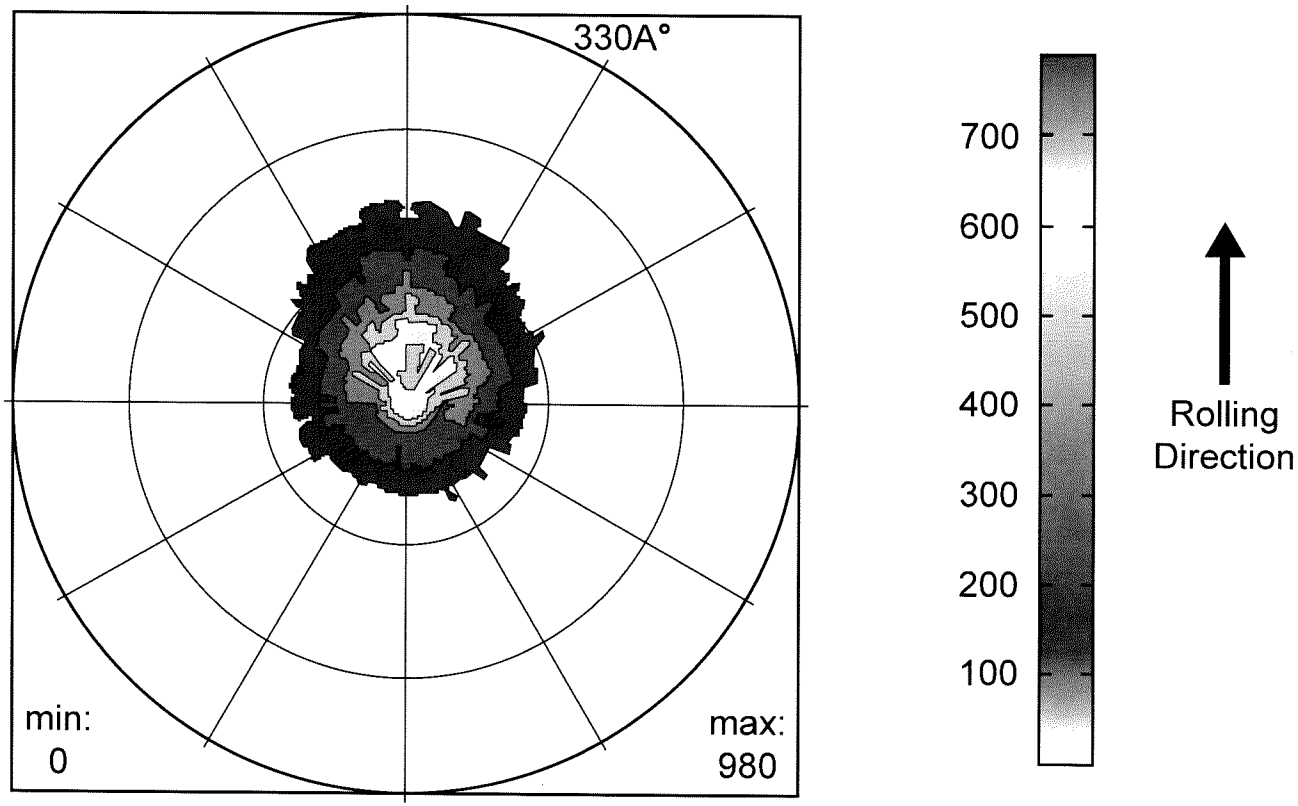
FIG. 17 is a {0002} pole figure observed near the slow roll surface in a specimen of AZ31B following multi-pass rolling at 225° C. in accordance with an example of the present invention.

Magnesium alloy AZ31B work-pieces were preheated to 225° C. and rolled in accordance with the present invention as follows: A multiple pass sequence of 4% to 14% strain per pass with a preheat temperature of 225° C. is shown in Table 4. FIGS. 15-17 show a broad distribution of {0002} poles observed through the thickness in the specimen; the tilted basal texture is evident. Therefore it can be seen that the present invention successfully restricted the exit curl while maintaining the tilted basal texture according to the present invention.

TABLE 4

| Sheet ID | Pre-Pass Temperature (° C.) | Desired ϵ | Mill Set | Actual Post-Pass Thickness | Actual Strain |
|---|---|---|---|---|---|
| AZ31B-5 | 225 | −0.05 | 0.087 | 0.090 | 0.043 |
| | | | 0.081 | 0.084 | 0.069 |
| | | | 0.076 | 0.080 | 0.049 |
| | | | 0.071 | 0.077 | 0.038 |
| | | | 0.066 | 0.067 | 0.139 |
| | | | 0.059 | 0.061 | 0.094 |
| | | | 0.056 | 0.058 | 0.050 |
| Cumulative Total Actual Strain | | | | | 0.483 |

Example V

Figure 18:
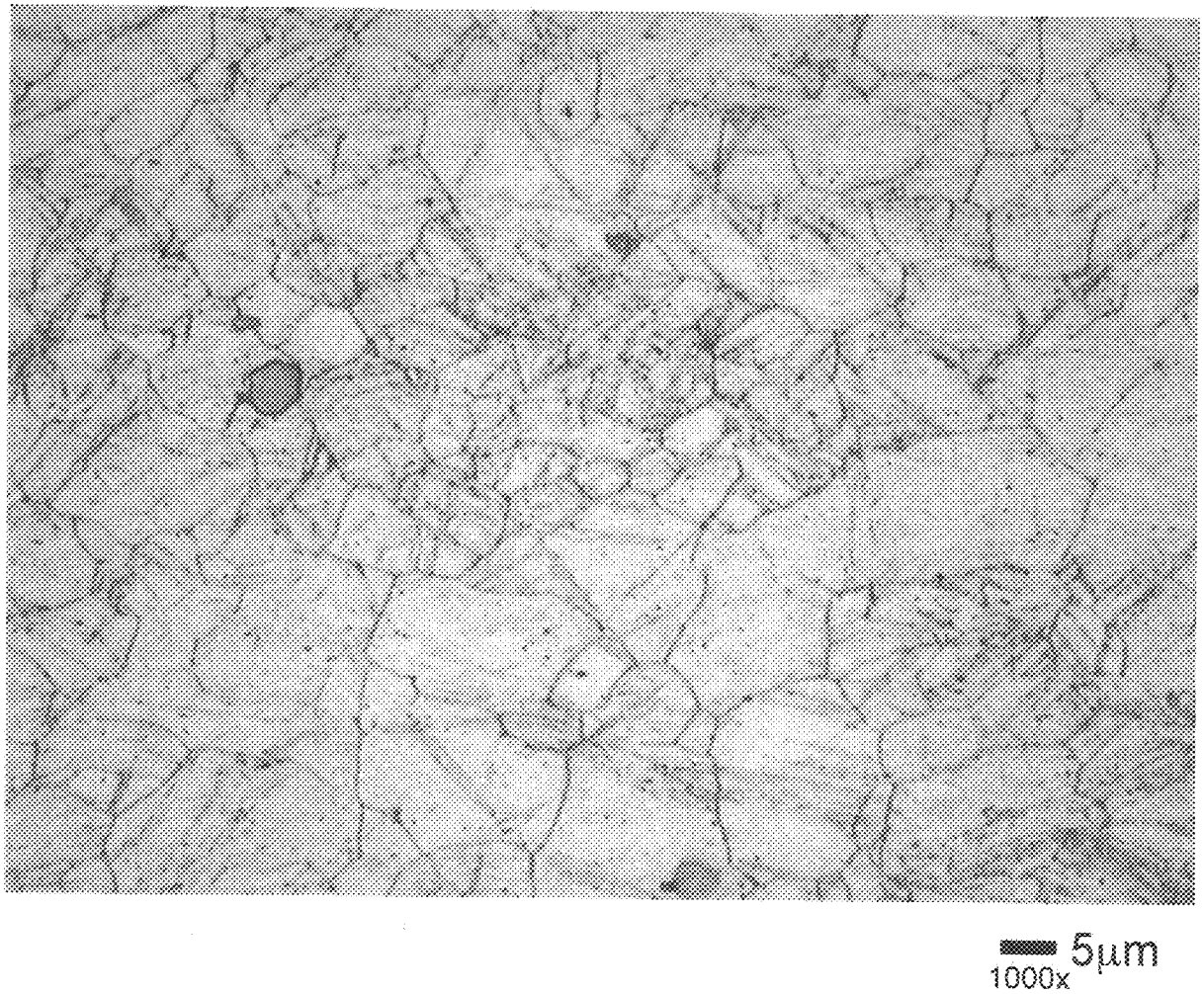
FIG. 18 is a photomicrograph of a work-piece of AZ31B rolled to 13% reduction at 135° C. in accordance with an example of the present invention.
Figure 19:
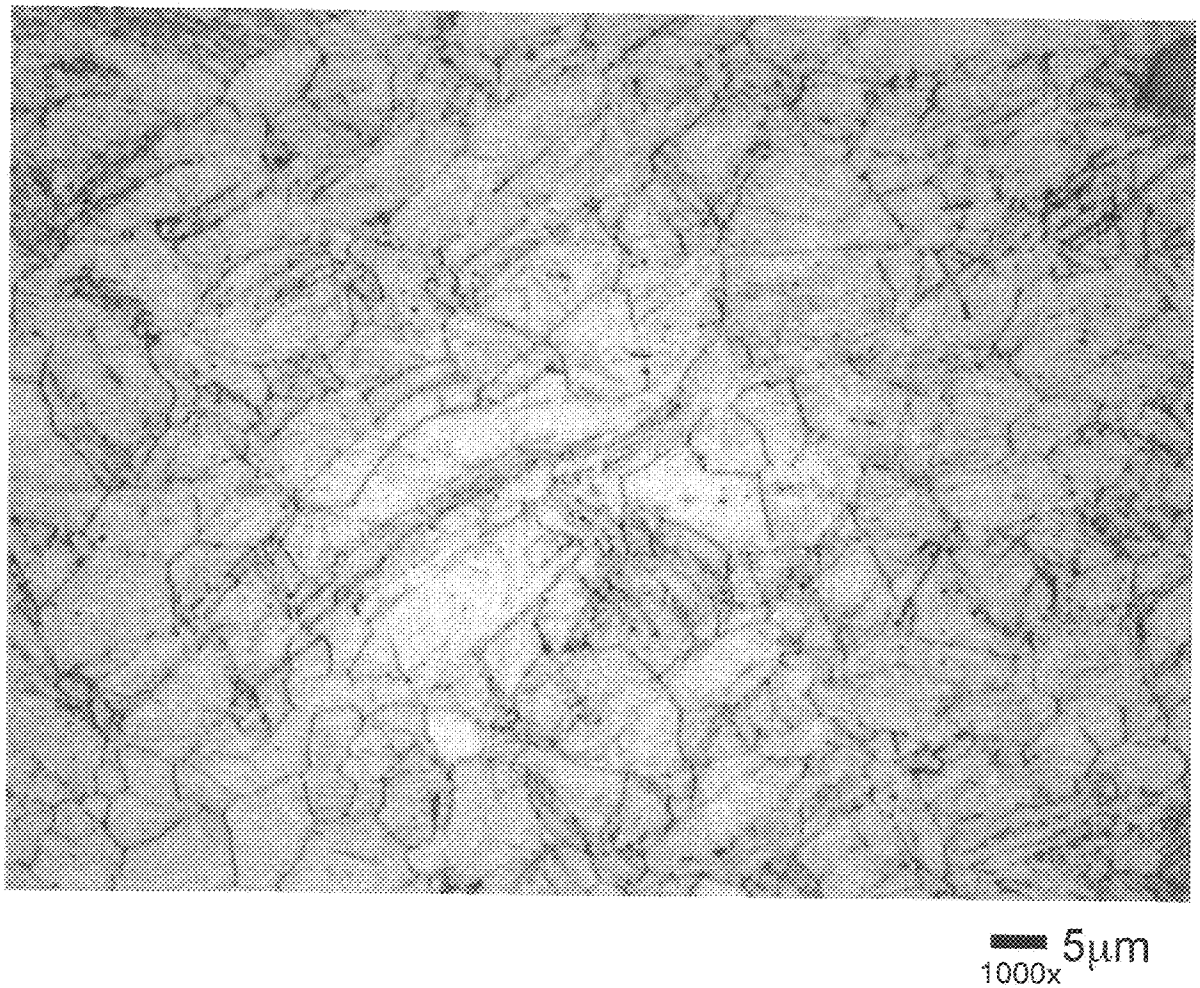
FIG. 19 is a photomicrograph of a work-piece of AZ31B rolled to 18% reduction at 180° C. in accordance with an example of the present invention.
Figure 20:
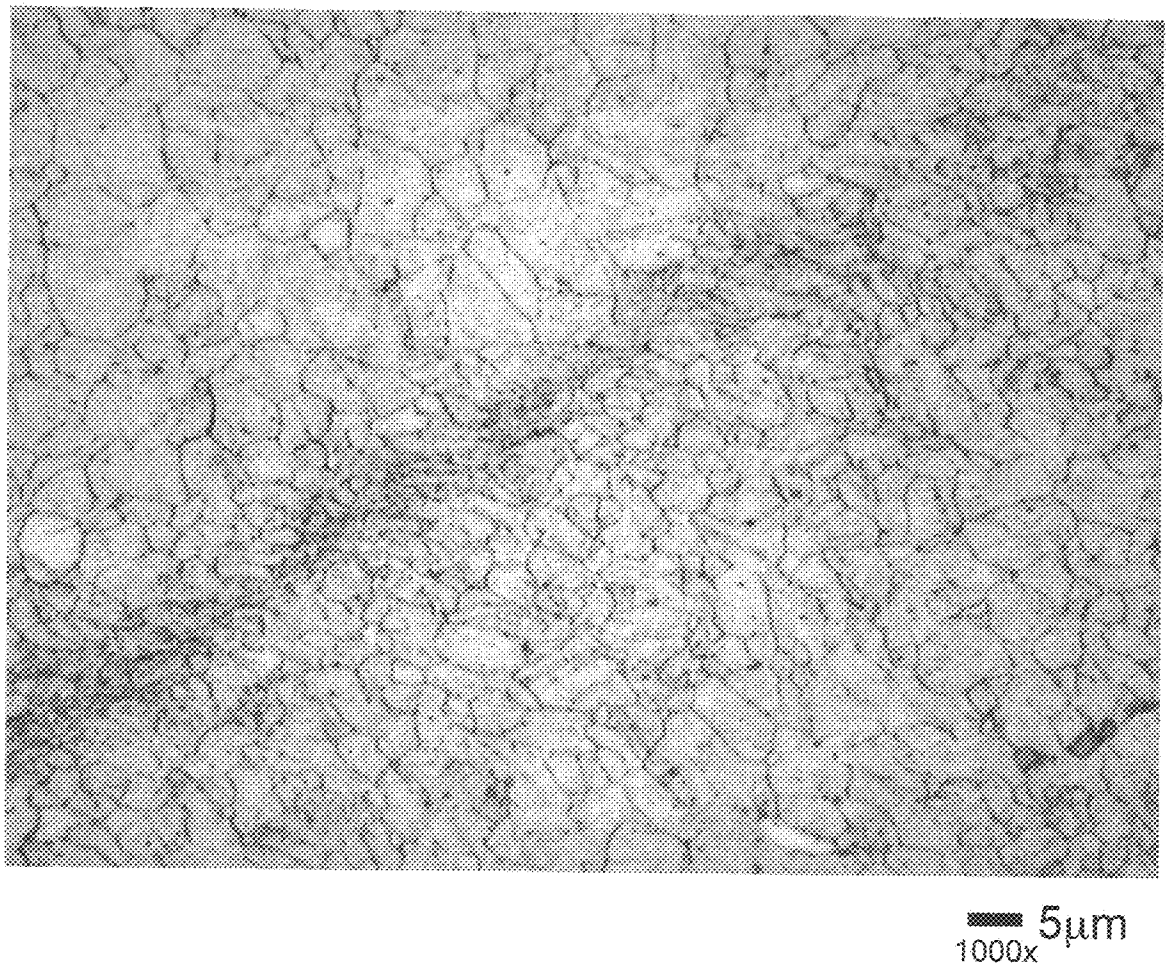
FIG. 20 is a photomicrograph of a work-piece of AZ31B rolled to 38% reduction at 225° C. in accordance with an example of the present invention.

Further AZ31B work-pieces were rolled and examined for evidence of recrystallization. FIGS. 18-20 are photomicrographs of specimens rolled to 13% reduction at 135° C., 18% reduction at 180° C., and 38% reduction at 225° C., respectively.

Example VI

A work-piece of magnesium alloy ZEK100, a rare earth containing alloy, was rolled in accordance with the present invention, resulting in an essentially flat work-piece having an improved texture. An example rolling schedule is shown in Table 5. The invention again performed according to design parameter and restricted exit curling. In all cases the invention restricted the exit curl. Table 5 shows the ZEK100 rolling schedule and results at 180° C. metal temperature in a multiple pass sequence.

TABLE 5

| Sheet ID | Pre-Pass Temperature (° C.) | Desired ϵ | Mill Set | Actual Post-Pass Thickness | Actual Strain |
|---|---|---|---|---|---|
| ZEK100-1 | 180 | −0.05 | 0.077 | 0.078 | 0.10 |
| | | | 0.073 | 0.074 | 0.07 |
| | | | 0.069 | 0.069 | 0.08 |
| | | | 0.063 | 0.064 | 0.08 |
| | | | 0.058 | 0.060 | 0.06 |
| | | | 0.049 | 0.051 | 0.16 |
| | | | 0.047 | 0.049 | 0.04 |
| Cumulative Total Actual Strain | | | | | 0.59 |

The present invention is also applicable to other hexagonal closed packed crystalline metals such as, for example beryllium and titanium, to effect texture improvement; body center cubic crystalline metals such as tantalum, iron, and various steels to impart texture; and face centered cubic metals such as aluminum and copper to impart texture.

Example VII

A beryllium work-piece is rolled in accordance with the present invention, resulting in an essentially flat work-piece having an improved texture.

Example VIII

A titanium work-piece is rolled in accordance with the present invention, resulting in an essentially flat work-piece having an improved texture.

Example IX

A tantalum work-piece is rolled in accordance with the present invention, resulting in an essentially flat work-piece having an improved texture.

Example X

An iron work-piece is rolled in accordance with the present invention, resulting in an essentially flat work-piece having an improved texture.

Example XI

A steel work-piece is rolled in accordance with the present invention, resulting in an essentially flat work-piece having an improved texture.

Example XII

An aluminum work-piece is rolled in accordance with the present invention, resulting in an essentially flat work-piece having an improved texture.

Example XIII

A copper work-piece is rolled in accordance with the present invention, resulting in an essentially flat work-piece having an improved texture.

While there has been shown and described what are at present considered to be examples of the invention, it will be obvious to those skilled in the art that various changes and modifications can be prepared therein without departing from the scope of the inventions defined by the appended claims.

What is claimed is:

1. A method of rolling a work-piece comprising the steps of:

a. heating a work-piece to a preselected rolling temperature;

b. using rollers, rolling the work-piece asymmetrically between a faster rate roller and a slower rate roller to form a tilted crystalline texture in the work-piece which curls in the direction of the slower rate roller; and c. stripping the rolled work-piece from said slower rate roller, the stripping comprising stripping with a stripper blade positioned adjacent to the slower rate roller, and guiding the work-piece with a guide surface toward and into an exit constraint slot, the exit constraint slot being distanced from the stripper blade in the direction of movement of the work-piece and the guide surface being positioned between the stripper blade and the exit constraint slot, the space between the surface of the faster rate roller and the exit constraint slot being open, and passing the rolled, stripped work-piece through the exit constraint slot to limit curling of the rolled work-piece and maintain the tilted crystalline texture as the rolled work-piece exits said rolling step.

2. A method in accordance with claim 1 wherein the rolling step is carried out isothermally.

3. A method in accordance with claim 1 wherein the constraining step is carried out isothermally.

4. The method of claim 1, wherein the guiding step comprises contacting the work-piece with a low friction guide surface.

5. A method of rolling a metal body comprising magnesium, the method comprising the steps of:

a. heating the metal body to a preselected rolling temperature in the range of 130° C. to 350° C.;

b. rolling the metal body asymmetrically between a faster rate roller and a slower rate roller to form a tilted crystalline texture in the metal body which curls in the direction of the slower rate roller; and c. stripping the rolled work-piece from said slower rate roller, the stripping comprising stripping with a stripper blade positioned adjacent to the slower rate roller, and guiding the work-piece with a guide surface toward and into an exit constraint slot, the exit constraint slot being distanced from the stripper blade in the direction of movement of the work-piece and the guide surface being positioned between the stripper blade and the exit constraint slot, the space between the surface of the faster rate roller and the exit constraint slot being open, and passing the rolled, stripped work-piece through the exit constraint slot to limit curling of the rolled work-piece and maintain the tilted crystalline texture as the rolled work-piece exits said rolling step.

6. A method in accordance with claim 5 wherein the rolling step is carried out isothermally.

7. A method in accordance with claim 5 wherein the constraining step is carried out isothermally.

8. The method of claim 5, wherein the guiding step comprises contacting the work-piece with a low friction guide surface.

* * * * *